US008096543B2

(12) United States Patent
Toyoizumi et al.

(10) Patent No.: US 8,096,543 B2
(45) Date of Patent: Jan. 17, 2012

(54) POST-PROCESSING APPARATUS AND IMAGE FORMING SYSTEM

(75) Inventors: Teruhiko Toyoizumi, Tachikawa (JP); Hirofumi Nakajima, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 215 days.

(21) Appl. No.: 12/572,421

(22) Filed: Oct. 2, 2009

(65) Prior Publication Data

US 2010/0090388 A1 Apr. 15, 2010

(30) Foreign Application Priority Data

Oct. 14, 2008 (JP) ..... 2008-265009

(51) Int. Cl.
*B65H 37/04* (2006.01)

(52) U.S. Cl. ..... 270/58.07; 270/58.08; 270/58.09; 270/58.11

(58) Field of Classification Search ..... 270/58.1, 270/58.07, 58.08, 58.09, 58.11
See application file for complete search history.

(56) References Cited

U.S. PATENT DOCUMENTS 5,628,502 A * 5/1997 Amarakoon ..... 270/58.07
5,709,376 A * 1/1998 Ushirogata ..... 270/58.11
7,201,368 B2 * 4/2007 Tanigami et al. ..... 270/58.11
2006/0022395 A1 * 2/2006 Tanigami et al. ..... 270/58.08
2008/0106032 A1 * 5/2008 Kanda ..... 271/279
2008/0258373 A1 * 10/2008 Wakabayashi et al. .... 270/58.17

FOREIGN PATENT DOCUMENTS

JP 2004-261951 A 9/2004
JP 2007-156406 A 6/2007

* cited by examiner

*Primary Examiner* — Leslie A Nicholson, III

(74) *Attorney, Agent, or Firm* — Holtz, Holtz, Goodman & Chick, PC

(57) ABSTRACT

A post-processing apparatus including: a first conveyance section which superposes a plurality of paper sheets conveyed from an image forming apparatus, and conveys with superposed state; a second conveyance section which conveys the paper sheets, sheet by sheet; a switching section which switches to convey the paper sheets either to the first or to the second conveyance section; a punch processing section which temporally stops the paper sheets from the first or the second conveyance section, and forms punch holes on the paper sheets; and a control section, wherein if determined, based on the basis weight or thickness information of the paper sheet, that the punch processing is not executable on the paper sheets with the superposed state, the control section controls to convey the paper sheets into the second conveyance section, and to execute the punch processing sheet by sheet.

17 Claims, 9 Drawing Sheets

POST-PROCESSING APPARATUS AND IMAGE FORMING SYSTEM

CROSS REFERENCE TO RELATED APPLICATION

The present application is based on Japanese Patent Application No. 2008-265009 filed with Japanese Patent Office on Oct. 14, 2008, the entire content of which is hereby incorporated by reference.

BACKGROUND OF THE INVENTION

1. Technical Field

This invention relates to a post-processing apparatus provided with a punch processing section capable of forming a punch hole on a paper sheet.

2. Description of Prior Art

In an image forming system in which a post-processing apparatus is connected with an image forming apparatus, the post-processing apparatus is desired to be capable of conducting various post-processing. As a kind of post-processing apparatus, a post-processing apparatus to form punch holes for filing is available.

In this kind of post-processing apparatus, there are two types of punch processing methods: (1) a batch method where the punch processing is correctively conducted after image formed paper sheets are bundled, (2) a sequential method where the punching process is conducted on each one paper sheet, and paper sheets formed with punch holes are bundled after being conveyed downstream. In the sequential method, a punch processing section is arranged on a conveyance path, and the punch processing is executed after the paper sheet is temporally stopped on the conveyance path, then, upon finishing the punch processing the paper sheet is again conveyed downstream (please refer to Unexamined Japanese Patent Application Publication No. 2004-261951: JP 2004-261951A).

In the batch method, maximum thickness of paper sheets (number of paper sheet of the bundled paper sheets) capable of punch processing is determined by an ability of the punch processing section, however, in the sequential method in many cases said maximum thickness does not mattered since the punch processing is conducted by each one paper sheet.

Meanwhile, in cases where an image forming system capable of various post-processing is utilized in a field of light printing (or in-plant printing), increased number of paper sheet capable of processing per unit time period (hereinafter referred as productivity) is desired. Further, in many cases this productivity is determined by the ability of the post-processing apparatus rather than the image forming apparatus.

In the post-processing apparatus, since the paper sheet is usually stopped temporally for processing, it is necessary to ensure a sufficient interval distance between sequentially conveyed paper sheets (hereinafter referred as paper sheet interval). As a means for the above, it is practiced to increase the paper sheet conveyance speed in the post-processing apparatus faster than the paper sheet conveyance speed in the image forming apparatus. However, in the high speeding trend of recent years, since the conveyance speed of the image forming apparatus has been considerably increased, further increase of the conveyance speed in the post-processing apparatus is nearly facing the limit.

Unexamined Japanese Patent Application Publication No. 2007-156406 (JP2007-156406A) discloses an apparatus which is provided with a superposing section to pile up a plurality of paper sheets in an intermediate conveyance unit, and correctively conveys the piled up paper sheets from superposing section. In this way, by correctively conveying the plurality of piled-up paper sheets, the paper sheet interval can be prolonged according to the number of superposed paper sheets without increasing the conveyance speed. Namely, the productivity in the post-processing section can be improved.

In a post-processing apparatus utilizing the sequential punch processing section disclosed in JP2004-261951A, the drive motor to activate a punch for conducting punch processing, may be the one which can only give a cutting power to form punch holes on a single paper sheet. However, due to the procedure of stopping the paper sheet on the conveyance path for punch processing and conveying the paper sheet again after the punch processing, processing speed, namely moving speed of the punch is required to be increased compared to the case of the batch method.

According to the above background, and various view points such as cost, selections for the configuration of post-processing apparatus having been conducted, as the result, for the sequential punch processing section, in many cases the configuration is selected to be optimal for the maximum thickness of paper sheets (number of paper sheet of the bundled paper sheets) capable of punch processing is a single paper sheet.

In these cases, when the post-processing apparatus having the superposing section disclosed in JP2007-156406A is utilized in combination in order to improve the productivity, a plurality of paper sheets are conveyed in superposed state. In cases where the plurality of paper sheets are punch processed, there can be a possibility of exceeding the upper limit of punch processable thickness. In these cases, excessive load is applied to the punch processing section, and may be caused a failure of forming a right hole or breakage of the punch processing section.

Further, in a light printing area, highly required is to handle various types of paper sheets including very thick paper of extremely high basis weight of paper. In these cases, even in the case of punch processing per single paper sheet, the upper limit of punch processable thickness can be exceed, and problems similar to the above mentioned can be caused.

Considering the above problems, an object of the present invention is to provide a post-processing apparatus with high productivity in total system without causing problems such as the breakage of the punch processing section.

SUMMARY

In order to achieve the above-mentioned object, post-processing apparatus and an image forming system reflecting an aspect of the present invention have following configurations:

(1) A post-processing apparatus including:

a first conveyance section which superposes a plurality of paper sheets conveyed from the image forming apparatus, and provided with a conveyance path for conveying the plurality of paper sheets with superposed state toward downstream;

a second conveyance section which conveys the plurality of paper sheets conveyed from the image forming apparatus, sheet by sheet toward downstream;

a switching section which switches to convey the plurality of paper sheets either to the first conveyance section or to the second conveyance section;

a punch processing section which being provided in downstream side of the first and second conveyance sections, and temporally stops the plurality of paper sheets conveyed from the first or the second conveyance section on a conveyance path, and executes punch processing to form punch holes on the plurality of paper sheets; and a control section which controls the switching section and the punch processing section, wherein in cases where it is determined, based on the basis weight information or thickness information of the paper sheet, that the punch processing is not executable at the punch processing section on the plurality of paper sheets with the superposed state, the control section controls the switching section and the punch processing section to convey the plurality of paper sheets into the second conveyance section, and to execute the punch processing sheet by sheet on the plurality of paper sheets.

(2) The post-processing apparatus of (1), wherein in cases where it is determined, based on the basis weight information or thickness information of the paper sheet, that the punch processing is not executable at the punch processing section on the plurality of paper sheets with the superposed state, the control section controls the switching section and the punch processing section to convey the plurality of paper sheets into the second conveyance section, and to execute the punch processing sheet by sheet on the plurality of paper sheets, and in addition, the control section requests the image forming apparatus to make a number of paper sheets to be conveyed from the image forming apparatus per unit time period less than the number of paper sheets in a case of conveying the paper sheets into the first conveyance section.

(3) The post-processing apparatus of (1), further comprising a paper sheet information acquiring section which acquires basis weight information or thickness information of the paper sheet.

(4) The post-processing apparatus of (3), wherein the paper sheet information acquiring section acquires the basis weight information or thickness information of the paper sheet from the image forming apparatus.

(5) The post-processing apparatus of (3), wherein the paper sheet information acquiring section is a paper thickness detection sensor to detect thickness information of the paper sheet, the sensor being provided at upstream side of the punch processing section in paper sheet conveyance direction.

(6) The post-processing apparatus of (3), wherein the control section determines, based on the basis weight information or thickness information acquired by the paper sheet information acquiring section, whether the punch processing is executable or not at the punch processing section on the plurality of paper sheets with the superposed state.

(7) The post-processing apparatus of (1), wherein the punch processing section is capable of changing of a number of punch holes to be formed on the paper sheet at one time punch processing.

(8) The post-processing apparatus of (7), wherein the control section determines, based on the number of punch holes, and the basis weight information or thickness information acquired by the paper sheet information acquiring section, whether the punch processing is executable or not at the punch processing section on the plurality of paper sheets with the superposed state.

(9) An image forming system including:

an image forming apparatus which comprises an image forming section to form an image on a paper sheet, and a first control section; and a post-processing apparatus connected to the image forming apparatus, wherein the post-processing apparatus includes:

a first conveyance section which superposes a plurality of paper sheets conveyed from the image forming apparatus, and provided with a conveyance path for conveying the plurality of paper sheets with superposed state toward downstream;

a second conveyance section which conveys the plurality of paper sheets conveyed from the image forming apparatus, sheet by sheet toward downstream;

a switching section which switches to convey the plurality of paper sheets either to the first conveyance section or to the second conveyance section;

a punch processing section which temporally stops the plurality of paper sheets conveyed from the first or the second conveyance section on a conveyance path, and executes punch processing to form punch holes on the plurality of paper sheets; and a second control section which controls the switching section and the punch processing section, wherein in cases where it is determined, based on the basis weight information or thickness information of the paper sheet, that the punch processing is not executable at the punch processing section on the plurality of paper sheets with the superposed state, the second control section controls the switching section and the punch processing section to convey the plurality of paper sheets into the second conveyance section, and to execute the punch processing sheet by sheet on the plurality of paper sheets.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Hereinafter, the present invention will be described based on embodiments, however the present invention is not restricted to the present embodiments.

Figure 1:
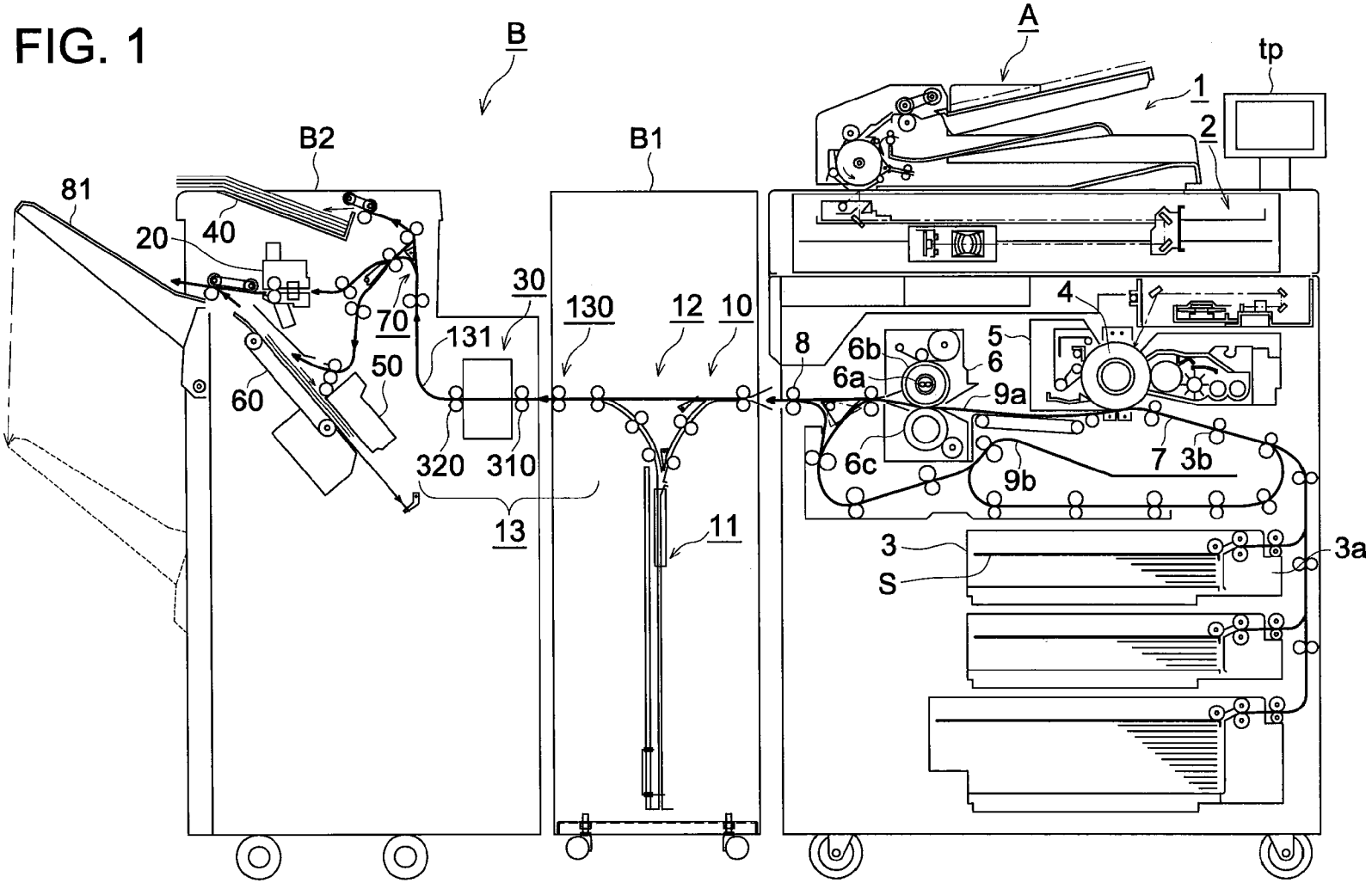
FIG. 1 illustrates a diagram showing an overall configuration of an image forming system having image forming apparatus A and post-processing apparatus B relating to the present invention.

FIG. 1 illustrates a diagram showing an overall configuration of an image forming system having image forming apparatus A and post-processing apparatus B relating to the present invention. Post-processing apparatus B is configured with intermediate conveyance apparatus B1 and post-processing apparatus B2, and intermediate conveyance apparatus B1 is connected in between image forming apparatus A and post-processing apparatus B2.

(Image Forming Apparatus A)

Image forming apparatus A has automatic document feeding apparatus 1 and image reading section 2 in upper side, and has a printer section in lower side.

In the printer section, symbol 3 shows a paper sheet feeding tray for housing a paper sheet S. At image forming section 5, a toner image is formed on photoconductive material 4 by an electrophotographic process including charging, exposure and developing. The toner image formed on photoconductive material 4 is transferred onto paper sheet S, and the image is fixed by fixing apparatus 6 on paper sheet S. Fixing unit 6 makes a nip to convey paper sheet S in between heat roller 6*b* and pressure roller 6*c*. In heat roller 6*b*, installed is heat source 6*a* whose heat generation is controlled to keep a constant temperature of heat roller 6*b*, based on the temperature detected by a temperature sensor (not illustrated). While being conveyed through the nip of fixing apparatus 6, paper sheet S is heated and pressed, and the toner image is fused and fixed on paper sheet S.

Paper sheet S is fed by first sheet feeding section 3*a* from sheet feeding tray 3 and re-fed after temporally stopped by second sheet feeding section 3*b*, the image is formed on the paper sheet S, and paper sheet S on which the image is formed is ejected by ejection roller 8 from an exit section.

As the pathway of paper sheet S, provided are sheet feeding path 7 extending from sheet feeding tray 3 to image forming section 5, conveyance path 9*a* extending from image forming section 5 through fixing apparatus 6 and ejection roller 8 to the exit section, and double side conveyance path 9 which reverses and switchbacks the image formed sheet and re-feeds to sheet feeding path 7.

Symbol tp indicates an operation display section which is configured with a touch panel arranged with a touch screen superposed on a liquid crystal display panel. A user can place a setting of image forming apparatus A and a setting of output mode for post-processing apparatus B by operations through operation display section tp. Further, the user can set information such as basis weight of paper, paper thickness, kind of sheet regarding the paper sheet S housed in each sheet feeding tray 3 of image forming apparatus A.

In image forming apparatus A, the number of paper sheet S being fed per unit time period can be varied. In normal setting of the present embodiment, the paper sheet S is conveyed with a sheet conveying speed of 1250 mm/sec, conveyance cycle of 300 mm (sheet interval of 90 mm) for consecutive conveyance of A4 size sheets, which results in 250 sheets/min of number of sheets conveyed from the image forming apparatus. For example, changing the number of sheets per unit time period, from said 250 sheets/min to 200 sheets/min, is possible by: (1) without changing the conveyance cycle, but changing the sheet conveyance speed to 1000 mm/sec; or (2) without changing the sheet conveyance speed, but changing conveyance cycle to 375 mm (sheet interval of 165 mm). In the description below, the example is explained where "the number of sheets to be conveyed from the image forming apparatus per unit time period" is changed by changing the sheet conveyance speed.

(Intermediate Conveyance Apparatus B1)

Paper sheet S ejected from image forming apparatus A is conveyed through intermediate conveyance apparatus B1 into subsequent post-processing apparatus B2.

Intermediate conveyance apparatus B1 is configured with sheet introduction section 10, superposing section 11, bypass conveyance path 12, and sheet discharge section 130. Superposing section 11 functions as "first conveyance section", bypass conveyance path 12 functions as "second conveyance section". Further, sheet ejection section 130 and punch processing section 30 (to be described below) configure "third conveyance section". In intermediate conveyance apparatus B1, it is possible to superpose a plurality of paper sheets conveyed from image forming apparatus A at superposing section 11, and to convey a set of the superposed paper sheets as it is toward subsequent post-processing apparatus B2.

(Subsequent Post-Processing Apparatus B2)

Subsequent post-processing apparatus B2 conducts various post-processing on paper sheets S, which have been ejected from image forming apparatus A, superposed to be a set of plurality of paper sheets at intermediate conveyance apparatus B1, and conveyed as the set of paper sheets; wherein the various post-processing may include functions of a folding machine, a side stitch binding machine, an center holding/center stitching machine, a glue binding machine and a cutting machine, in addition to punch processing by the punch processing section.

In subsequent post-processing apparatus B2, arranged from upper side in the drawing are first ejection tray 40, shifting unit 20, processing tray 60, stapling section 50, and punch processing section 30. Punch processing section will be described in detail later.

On the processing tray 60, a plurality of paper sheets on which images are formed by image forming apparatus A are temporally stacked to form a bundle of the paper sheets. Onto the stacked paper sheets at processing tray 60, after conducting vertical aligning in the conveying direction and width aligning in the direction perpendicular to the conveying direction, stapling is conducted by stapling section 50 which is faced to the bundle of paper sheets.

Shifting unit 20 conducts shift processing to change the sheet ejection position in the sheet width direction onto the image-formed sheets ejected from image forming apparatus A by every predetermined number of sheets.

At the right upper portion in the drawing of subsequent post-processing apparatus B2, relay conveyance section 70 is arranged. And, at the left side face in the drawing of subsequent post-processing apparatus B2, arranged is a movable second ejection tray 81 for stacking the ejected image formed paper sheets.

(Intermediate Conveyance Apparatus B1)

Figure 2:
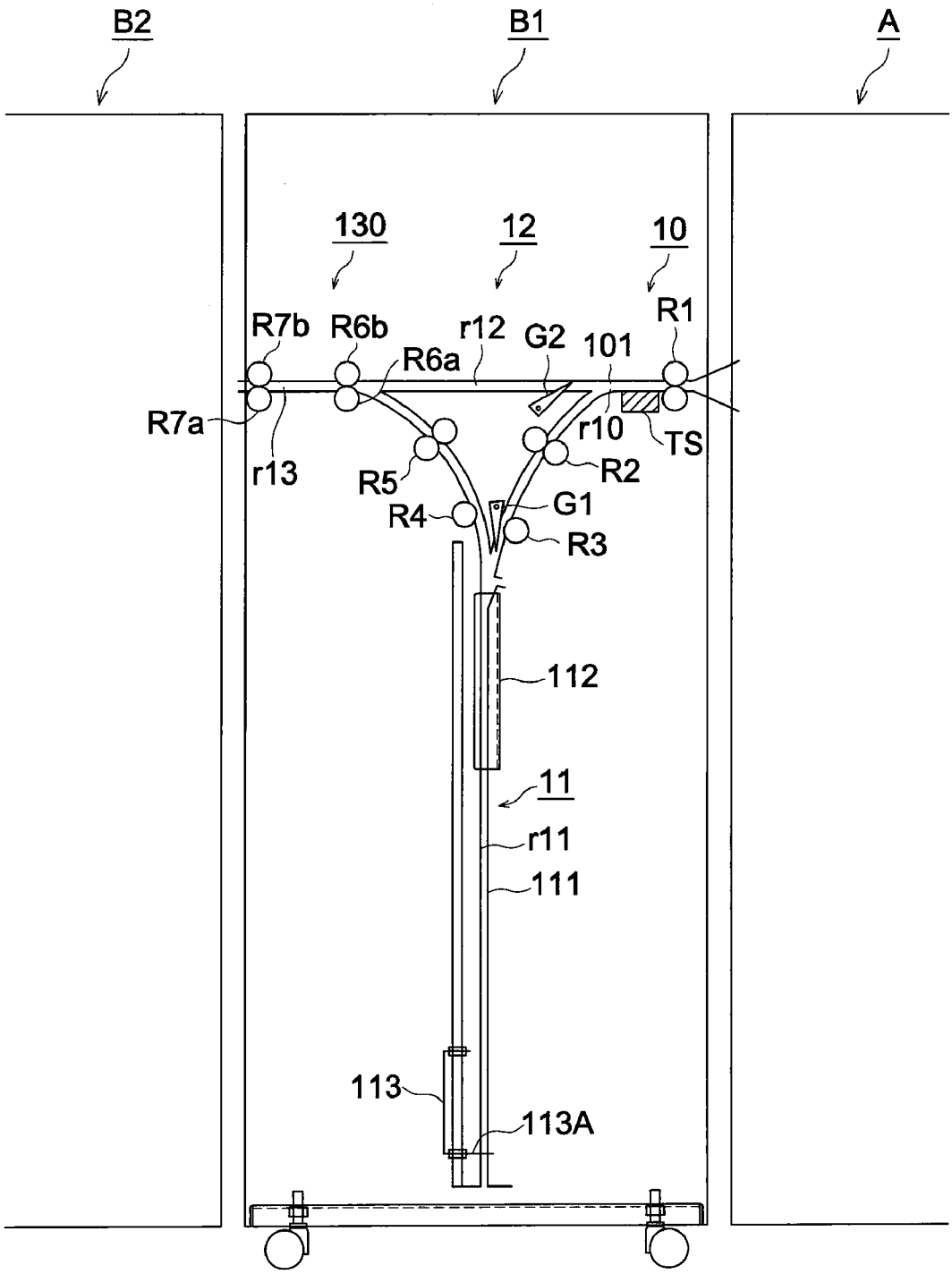
FIG. 2 illustrates an elevational view in section of intermediate conveyance apparatus B1.
Figure 3:
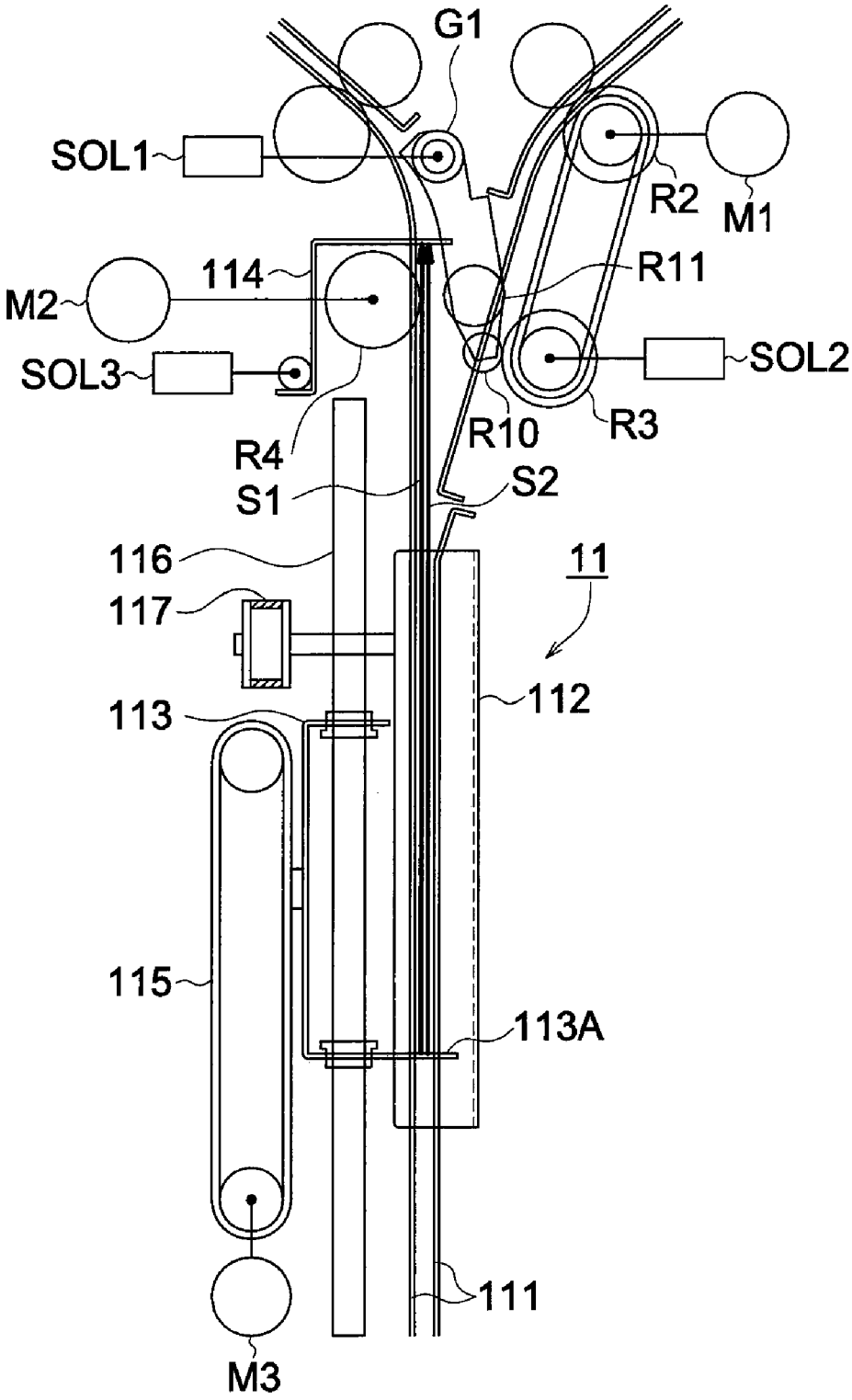
FIG. 3 illustrates a sectional view showing drive means in a periphery of superposing section 11 of intermediate conveyance apparatus B1.

Based on FIG. 2 and FIG. 3, sheets superposing operation in intermediate conveyance apparatus B1 will be explained. FIG. 2 illustrates an elevational view in section of intermediate conveyance apparatus B1, and FIG. 3 illustrates a sectional view showing drive means in a periphery of superposing section 11 of intermediate conveyance apparatus B1.

As described above, intermediate conveyance apparatus B1 is configured with sheet introduction section 10, superposing section 11, bypass conveyance path 12, and sheet discharge section 130.

Sheet introduction section 10 is provided with sheet conveyance path r10 which has conveyance rollers R1 and R2, and guide plate 101. At sheet introduction section 10, paper sheets S being ejected from ejection roller 8 of image forming apparatus A is sequentially accepted and conveyed.

Superposing section 11 is provided with parallel arranged two guide plates 111, vertical alignment section having stopper member 113 and vertical aligning member 114, width aligning member 112, introduction drive roller R3, ejection drive roller R4, and intermediate housing section r11. In super posing section 11, the plurality of paper sheets conveyed from sheet introduction section 10 is housed with superposed state in intermediate housing section r11 and aligned, after that the plurality of paper sheets are carried out upward with the superposed state.

Sheet discharge section 130 is provided with sheet conveyance path r13 including intermediate conveyance roller R5, and pairs of sheet ejection rollers (pairs of conveyance rollers) R6*a*, 6*b*; R7*a*, 7*b*. In sheet discharge section 130 the plurality of paper sheets S are reversed and conveyed with the superposed state and conveyed into subsequent post-processing apparatus B2.

Bypass conveyance path 12 is provided with sheet conveyance path r12. The paper sheet is introduced into bypass path in cases where the paper sheet needs not be conveyed into superposing section 11, for example in a case where it is determined not be able to execute punch processing with the superposed state (detail will be described later), a case where post-processing of the paper sheet is not required, or a case where the plurality of paper sheets are conveyed with large sheet intervals in such a case of non-continuous printing and the like.

By conveyance path switching section G2 arranged in sheet introduction section 10, the conveyed paper sheet S is divaricated into either superposing section 11 as the "first conveyance section" or bypass conveyance path 12 as the "second conveyance section". Above superposing section 11 arranged is conveyance path switching section G1. Conveyance path switching section G1 switches between the introduction of paper sheets into superposing section 12 and ejection of the paper sheets from superposing section 11. Conveyance path switching sections G1 and G2 are respectively driven by being connected to solenoids.

In FIG. 3, conveyance switching section G2 which holds introduction driven roller R10 and ejection driven roller R11 swings by driven with solenoid SOL 1. Introduction drive roller R3 is driven by solenoid SOL 2 to open and close the sheet conveyance path r10. Vertical aligning member 114 swings by driven with solenoid SOL 3.

Motor M1 drives to rotate conveyance roller R2 and rotates introduction drive roller R3 through a belt. Motor M2 drives to rotate ejection drive roller R4.

Stopper member 113 is locked to belt 115 which is turned by motor M3 and moves up and down guided by guide bar 116. The waiting position of the stopper member at the time of preparing to accept the paper sheet varies depending on the length of the paper sheet in conveying direction. As shown in FIG. 2, stopper member 113 is allowed to wait at lower position, the plurality of paper sheets are accepted in such condition, and alignment of the paper sheets are executed by width aligning member 112, vertical aligning member 114 and by stopper surface 113A of stopper member 113.

As shown in FIG. 2 and FIG. 3, the stopper member moves up after the alignment, the plurality of paper sheets are nipped by ejection drive roller R4 and ejection driven roller R11 as one set paper sheets (two sheets of S1 and S2 in FIG. 3) at the upper end portion. Vertical aligning member 114 retracts from the sheet conveyance path by driven with a solenoid (not illustrated). By the rotation of ejection drive roller R4, a set of paper sheets S1 and S2 nipped with ejection drive roller R4 and ejection driven roller R11 is conveyed to downstream sheet ejection section 130, and further nipped with a pair of intermediate conveyance rollers R5, the set of paper sheets are conveyed into subsequent post-processing apparatus B2.

As describe above, by reversing more than two paper sheets in superposed state through superposing section 11 of intermediate conveyance apparatus B1, and carrying out to subsequent post-processing apparatus B2, stalled time is made unnecessary for reversing conveyance the paper sheets in image forming apparatus A, and swift reversing conveyance is enabled.

In the description below, the number of paper sheets S housed in super posing section 11 is assumed to be two at maximum. However, as the embodiment of the present invention, the number of paper sheets should not be restricted to two, but three or more sheets can be superposed. Further, setting of the number of paper sheets may be properly determined by a control section taking in account of processing capability of subsequent post-processing apparatus B2.

In the embodiment shown such as in FIG. 2, the example is shown where the first conveyance section and the second conveyance section is respectively provided in different conveyance paths. However, not being restricted to this case, another configuration can be possible where an intermediate housing section is provided in a common and the same conveyance path, and this structure functions as the first conveyance section in the case of conveying the paper sheets by superposing at the intermediate housing section, and functions as the second conveyance section in the case of conveying without superposing.

(Punch Processing Section 30)

Figure 4:
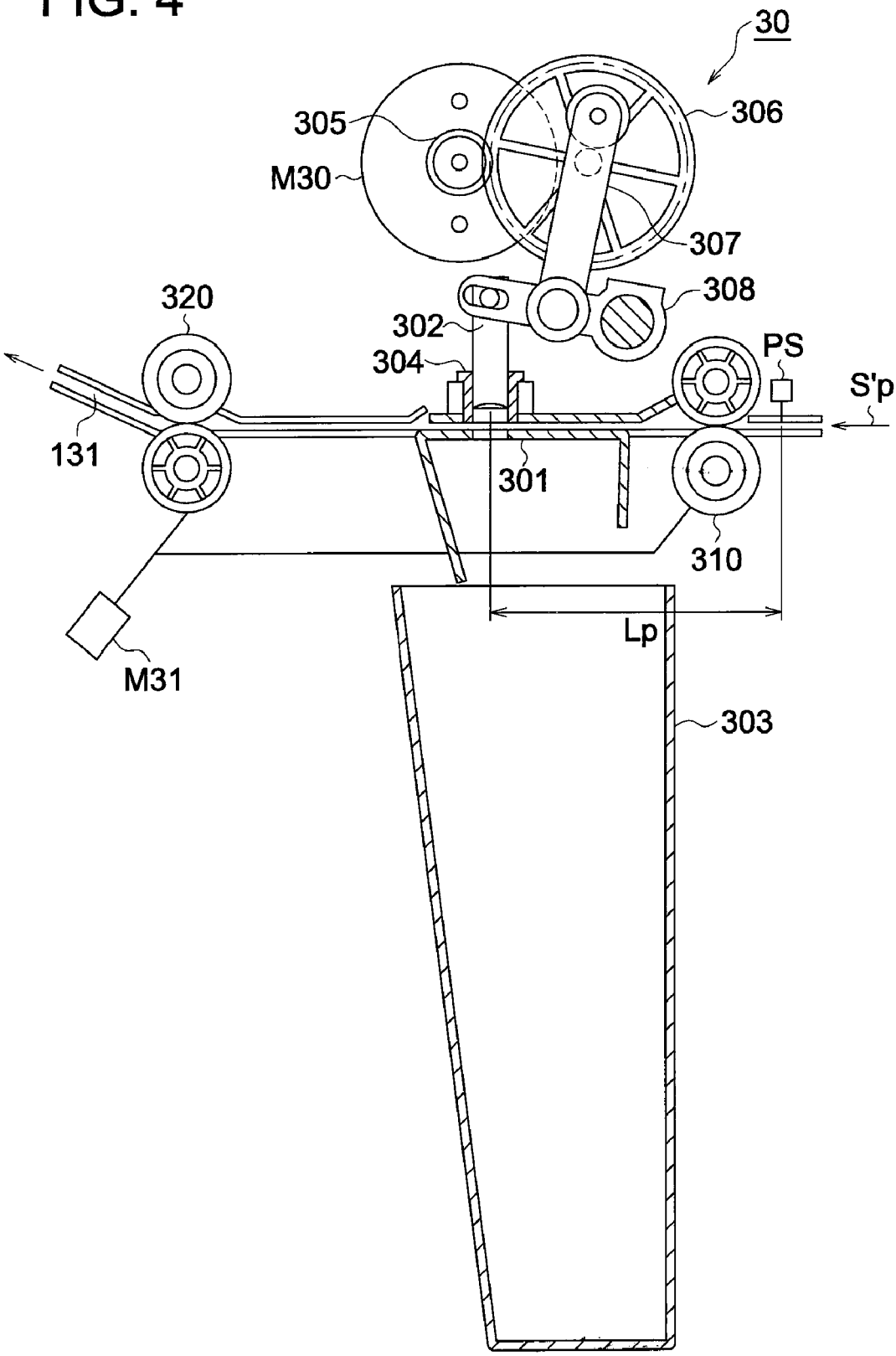
FIG. 4 illustrates a sectional view showing a periphery of punch processing section 30.

FIG. 4 is a sectional view of the periphery of punch processing section 30. In FIG. 4, punch processing section 30 includes die 301 fixed to a sheet conveyance path, punch 302 which moves up and down with being guided by guiding member 304 and fits to die 301, a drive unit to move punch 302, conveyance rollers 310 and 320 to convey the paper sheet S, waste container box 303 to contain punched pieces of paper, and a sensor PS to detect a paper sheet S passing through which is conveyed with nipped by conveyance rollers 310 and 320. 131 indicates a downstream conveyance path provided downstream of punch processing section 30.

Center position of punch 302 (or die 301) is apart from the detecting position of the paper sheet by sensor PS with a distance Lp. A plurality of punch 302 and holes of die 301 fitting to said punch 302 are arranged in the width direction of the paper sheet perpendicular to the conveyance direction in accordance with standardized positional relation of punch holes. In the present embodiment, the number of punch holes possible of processing at one time can be selected out of two, three or four.

The drive unit to drive punch 302 up and down includes drive motor 30, small gear 305 connected to drive motor 30, large gear 306 engaging to small gear 305, crank 307 which is swingably rotatable with being locked at one end portion of large gear 306, and drive transmission members such as connecting member 308 which connects the upper part of punch 302 and crank 307.

A plurality of punch 302 are driven to move up and down by a single motor M30 through small gear 305, large gear 306, crank 307, connecting member 308. By the fitting of punch 302 with die 301 caused by down drive of punch 302, punch processing is performed to form punch holes on the paper sheet S.

In punch processing section 30, passing of the paper sheet S conveyed with being nipped by conveyance roller 310 and 320 is detected by sensor PS. Upon detecting upstream edge of the paper sheet S, counting is started of the pulses of drive motor M31 which drives conveyance rollers 310 and 320, and when a prescribed count number is counted, drive motor M31 is stopped driving to stop proceeding the paper sheet S. As for drive motor M31, it is preferable to use a pulse motor whose rotational angle and speed is determined by drive pulses.

During when drive motor M31 stops, punch processing is executed on the paper sheet S at prescribed positions to form punch holes.

Position of punch holes in the conveyance direction of the paper sheet will be described. When the sensor PS detects the upstream edge of the paper sheet S being conveyed, counting of the drive pulses of drive motor M31 is started, and the drive of drive motor M31 is stopped when the pulse number reaches a second pulse number which correspond to a resulting distance of adding the distance Lp with punch edge distance b, where punch edge distance b is from the side edge a of the paper sheet to the center h of punch hole, and punch processing is executed.

In cases where punch processing is not conducted, the paper sheet S is allowed to pass through punch processing section 30 without processing, by without stopping drive motor M31.

Figure 5A:
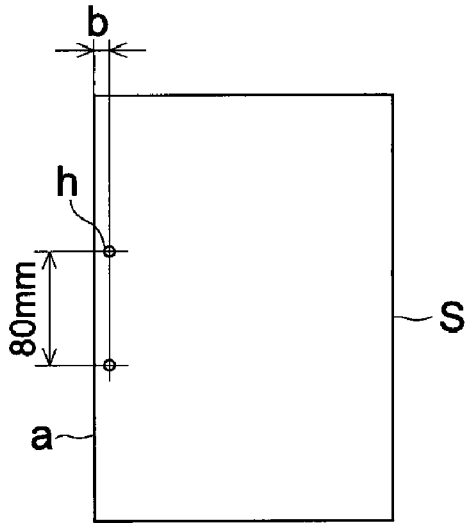
FIGS. 5*a*-5*c* illustrate plan view of various types of punch processed paper sheet S.
Figure 5B:
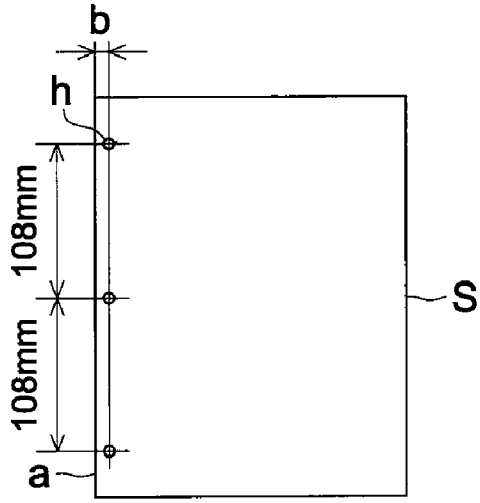
Figure 5C:
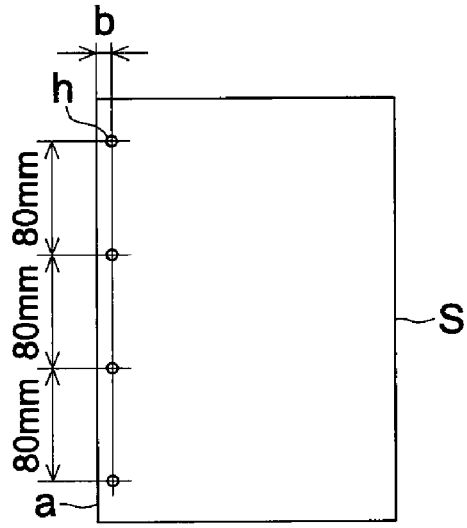

FIGS. 5*a*-5*c* illustrate plan view of various types of punch processed paper sheet S by punch processing section 30. FIG. 5*a* shows an example where punch holes are formed at two positions near the side edge a of the paper sheet S (the number of punch holes k=2). FIG. 5*b* shows an example where punch holes are formed at three positions near the side edge a of the paper sheet S (the number of punch holes k=3). FIG. 5*c* shows an example where punch holes are formed at four positions near the side edge a of the paper sheet S (the number of punch holes k=4).

Intervals between the plurality of punch holes h are standardized. Although punch edge distance b from the side edge a of the paper sheet to the center h of punch hole can be arbitrarily determined, punch edge distance b is generally within 9-11 mm. Further, punch hole diameter is 6 mm for example, and punch 302 is in a shape of cylinder corresponding to said punch hole diameter.

(Control Block)

Figure 6:
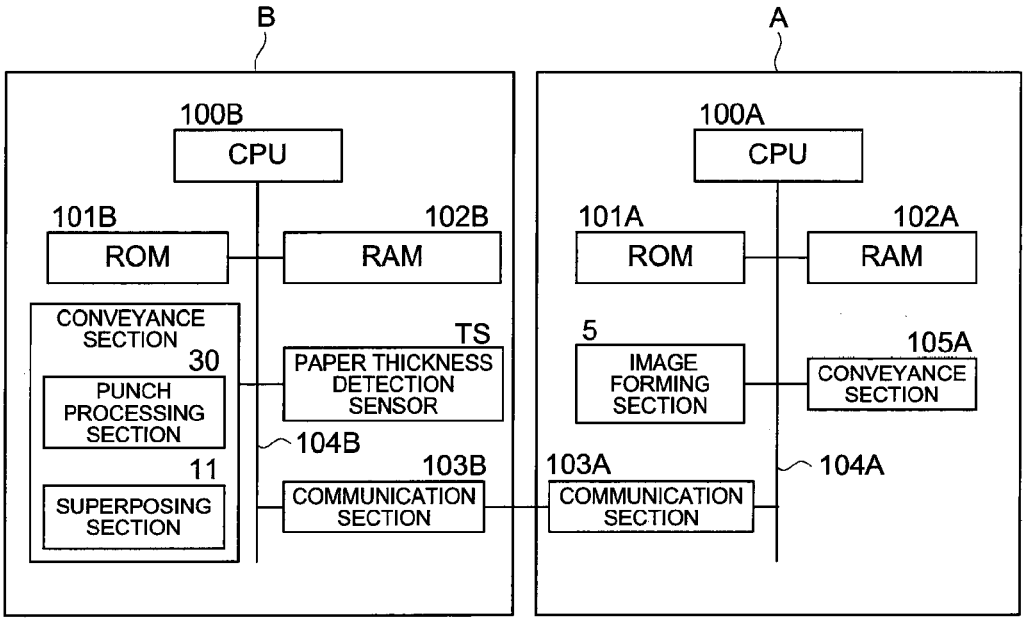
FIG. 6 illustrates a block diagram showing a control system of the image forming system.

FIG. 6 illustrates a block diagram showing a control system of the image forming system. In FIG. 6 mainly described is around a necessary part for explanation of operation of the present embodiment, and the other part commonly known as an image forming system is omitted. In the following drawings, common parts are given the same symbols instead of explanation in order to avoid duplication in explanation.

In post-processing apparatus B, 100B is a CPU which executes various controls of intermediate conveyance apparatus B1 in accordance with a program. 101B is a ROM which stores various programs and data including those for controlling intermediate conveyance apparatus B1. 102B is a RAM as a memory section and is utilizes as a work area by CPU 100B to temporarily store programs and data necessary for CPU 100B to execute the control of intermediate conveyance apparatus B1.

CPU 100B functions as a control section, and executes the total control of post-processing apparatus B based on a developed program on RAM 102B, and data.

103B is a communication section which is connected and communicates with communication section 103A of image forming apparatus. Through said communication section 103B, information of paper thickness, number of superposing paper sheets n and other information of a printing job can be acquired. 104B is a bus through which ROM 101B, RAM 102B, and communication section 103B, etc. are connected with each other. Paper thickness detection sensor TS is configured with a known thickness detection sensor utilizing transmitted light or ultrasonic wave. Said paper thickness detection sensor detects the thickness of the conveyed paper sheet. Paper thickness detecting sensor TS is provided on a conveyance path of sheet introduction section 10 which being upstream side of the third conveyance section 13 in the sheet conveyance direction (refer to FIG. 2).

105A in image forming apparatus A is a conveyance section which executes paper sheet conveyance by controlling the movements of a drive motor, and a solenoid of conveyance path switching, and the like. Other sections of 100A-104A of image forming apparatus A respectively correspond to each of 100B-104B of post-processing apparatus B, and have the similar functions.

Control Flow in the First Embodiment

Figure 7:
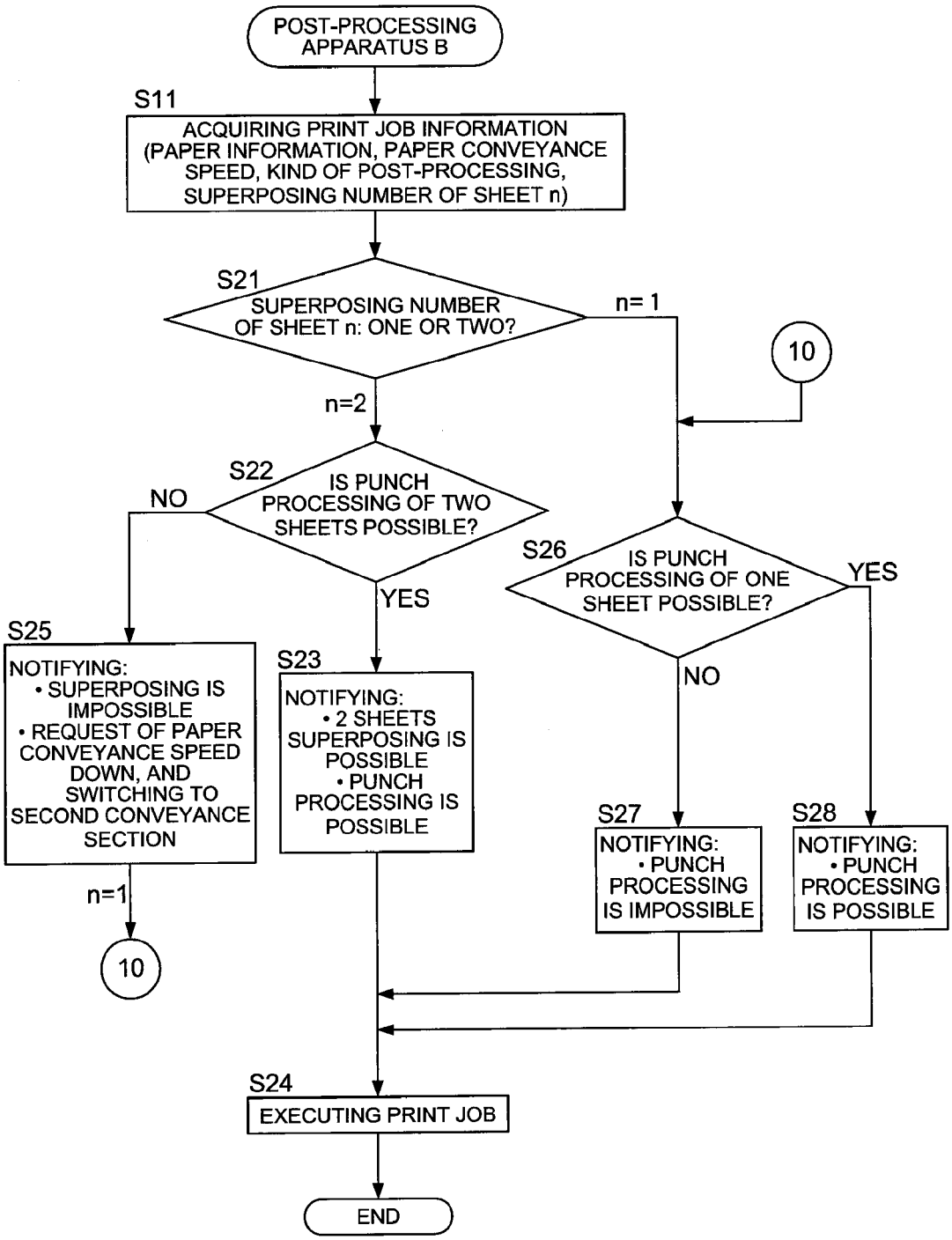
FIG. 7 illustrates a flow diagram showing a control flow by a control section of the post-processing apparatus in a first embodiment.

Next, explanation about a control flow will follow. FIG. 7 shows a control flow of the first embodiment to be executed by control section of the post-processing apparatus. In the present embodiment, preliminary to the execution of print job, post-processing apparatus B determines whether the print job is executable or not, and notify the result of determination to image forming apparatus A.

In step S11 of FIG. 7, CPU 100B (hereinafter simply referred a control section) which functions as a control section acquires print job information from image forming apparatus via communication section 103B. Herein, the print job information includes (1) paper information such as basis weight of paper information, thickness information, and sheet size of the paper sheet to be conveyed from image forming apparatus A, (2) sheet conveyance speed information, (3) type of post-processing (availability and conditions of punch processing, staple processing, and fold processing, etc.), (4) number of sheets to be superposed, (5) number of sheets to be printed in the print job. In the first embodiment, communication section 103B functions as a "sheet information acquiring section", and the print job information received by communication section 103B includes basis weight of paper information (or paper sheet thickness information).

In step S21, the control section determines whether information of the number n of the sheets to be superposed, included in the print job information acquired in step S11, is one or two. Here, in the embodiment shown in FIG. 7, the case is explained where the superposing number of sheets n is included in the print job information. However not restricting to this case, the other case is possible where the control section of the post-processing apparatus B determines on the side of post-processing apparatus B based on sheet conveyance speed information and information of post-processing type and the like, whether it is executable with superposing number of sheet n=2 or executable with n=1.

In a case where the control section determines as n=2 in step S21, in the following step S22 the control section calculates the maximum punch processable sheet number m based on basis weight (g/m$^2$) of paper, and determines whether punch processing is possible or not by comparing said maximum punch processable sheet number m with number of sheets n to be superposed (=number of sheets to be punched at one time). If the maximum punch processable sheet number m number of sheets n, the punch processing is possible.

TABLE 1

| basis weight of paper | punch processing max sheet number m |
|---|---|
| 67 g/m$^2$ | 3 sheets |
| 90 g/m$^2$ | 2 sheets |
| 200 g/m$^2$ | 1 sheet |
| 300 g/m$^2$ | not possible |

Table 1 is a reference table of basis paper weight and maximum sheet number of punch processing. Said table is stored in ROM 101B in advance. The table is determined based on capability of punch processing section 30. In the present embodiment, total basis weight of 220 g/m$^2$ is set to be the maximum basis weight capable of punch processing. (1) in the case where the number of sheet to be punch processed at a time is 1, up to basis weight of 220 g/m$^2$ of paper is possible, and (2) in the case where the number of sheet to be punch processed at a time is 2, up to basis weight of 110 g/m$^2$ of paper is possible to be punched.

The maximum punch processable basis weight of paper sheet is generally proportional to the area of cut surface formed by cutting (punching) at one time (total circumferential area of a cylindrical hole formed by one time punching). If the thickness of the paper sheet becomes twice or the number of punch holes becomes twice, the total area of cut surface becomes twice, thus required cutting ability becomes twice. In the reference table of table 1, as for the number of punch holes k, the total area of cut surface in the case of maximum number of k=4 is taken into account for determining the values. Further, although table 1 is based on the relations between the basis weight of paper and the maximum punch processable number of sheets, the table based on the relations between the thickness of paper and the maximum punch processable number of sheets is also applicable, and further these two types of reference tables can be used in combination.

Returning to FIG. 7, for example in cases where the basis weight of the paper sheet is 67 g/m$^2$, the maximum punch processable number of sheets m=3, and the superposing number of sheet n=2, the relation becomes m≧n and it is determined that punch processing by punch processing section 30 is possible with the 2 sheets superposed state (step S22: YES). In such the case, in the succeeding step S23, it is notified to image forming apparatus A that "2 sheets superposing is possible" and "punch processing is possible".

In step S24, image forming apparatus A starts the print job based on the notification, and post-processing apparatus B executes the print job based on the setting and finishes the job.

On the other hand, for example in cases where the basis weight of the paper sheet is 200 g/m$^2$, the maximum punch processable number of sheets m=1, and the superposing number of sheet n=2, the relation becomes m<n and it is determined that punch processing by punch processing section 30 is not possible with the 2 sheets superposed state (step S22: NO). In such the case, in the succeeding step S25, it is notified to image forming apparatus A that "2 sheets superposing is not possible" and "paper conveyance speed is requested to be slowed down (request for decreasing the conveying number of sheets per unit time period)". Further the control section switches the conveyance path of the paper sheets to bypass conveyance path 12, which functions as the second conveyance section not passing through superposing section 11 (change to no superposing: and the number of superposing sheet n=1), and image forming apparatus A changes the sheet conveyance speed for executing the print job.

TABLE 2

| superposing number of sheets n | sheet conveyance speed |
|---|---|
| 2 sheets | 1250 mm/sec |
| 1 sheet | 1000 mm/sec |

Table 2 is a reference table showing the acceptable sheet conveyance speed for post-processing apparatus B in cases of superposing number of sheets n=2 and n=1 at superposing section 11. The acceptable sheet conveyance speed in the reference table can be further segmentalized in accordance with the types of post-processing. Said reference table is previously stored in ROM 101B. Based on said reference table, the control section requests for image forming apparatus A to slow down the sheet conveyance speed from 1250 mm/sec to 1000 mm/sec. Namely requests to decrease "the conveying number of sheets from the image forming apparatus per unit time period".

In step S26 succeeding (through signal 10) to step S25, further determined is whether or not punch processing with one sheet is possible. For example if the basis weight of the paper sheet is 300 g/m$^2$, the punch processing is determined to be impossible even for 1 sheet of paper based on the reference table 1 (step S26: NO), the control section notifies to image forming apparatus A to the effect that the punch processing is impossible in the succeeding step S27. At image forming apparatus A, print job setting is changed as necessary, based on the notification.

On the other hand, for example in cases where the basis paper weight is 200 g/m$^2$, and one sheet punch processing is determined to be possible (step S26: YES), the control section notifies to image forming apparatus A to the effect that the punch processing is possible in the succeeding step S28.

In step S24, image forming apparatus A starts the print job based on the notification, and post-processing apparatus B executes the print job based on the setting and finishes the job.

According to the present embodiment, whether the punch processing is possible or not with superposing state of the paper sheets, and the result is notified to the image forming apparatus, therefore, problems such as breakage of the punch processing section are prevented and productivity as total system can be improved.

Second Embodiment

Next, the second embodiment will be described. In the second embodiment, thickness of the paper sheet is detected by paper thickness detection sensor TS (refer to FIG. 2), and based on the detected value capable or not of the punch processing is determined. Accordingly, possible or not of the punch processing is determined after the first paper sheet for the print job is conveyed, which differs from the first embodiment.

Figure 8:
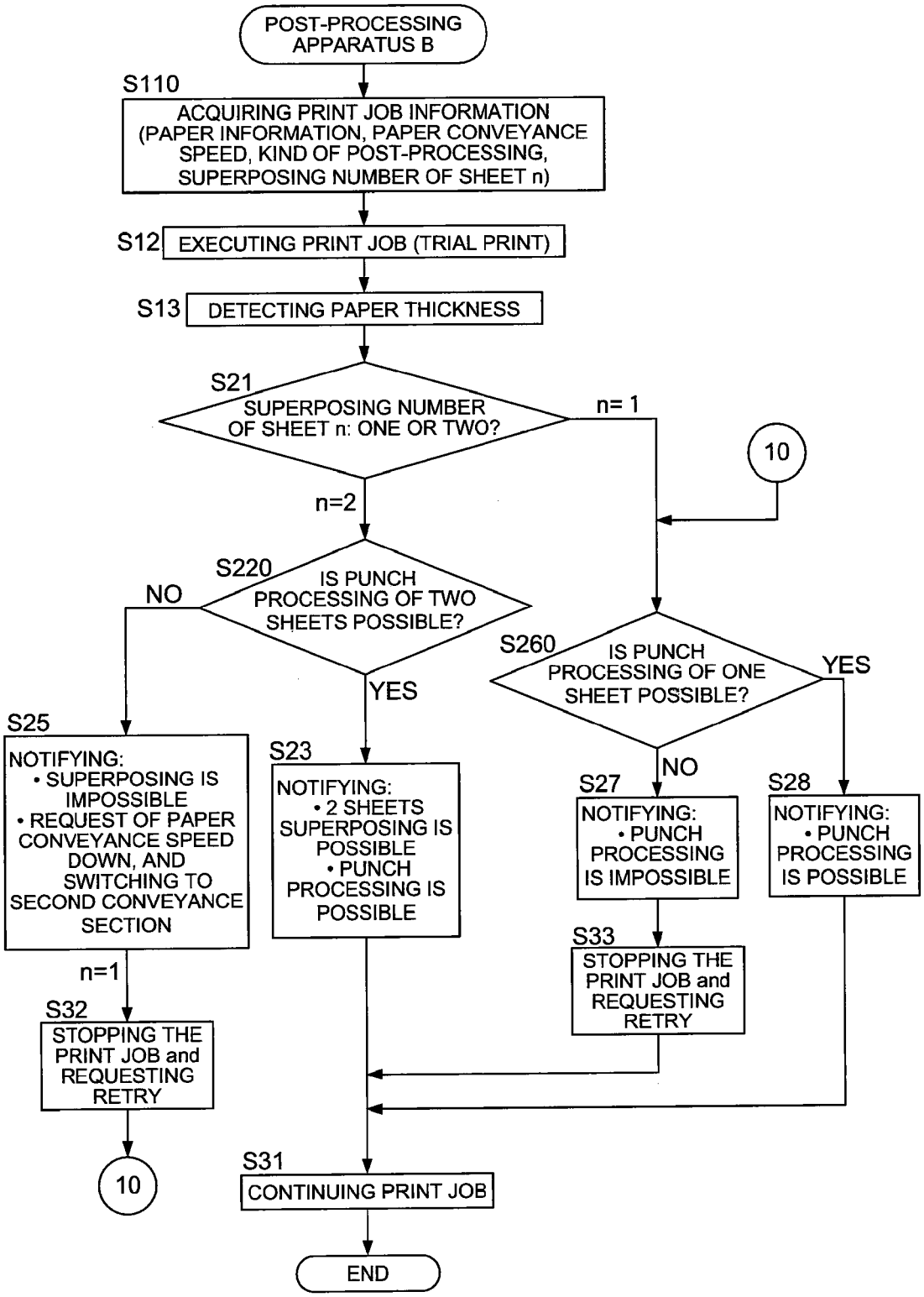
FIG. 8 illustrates a control flow diagram in a second embodiment.

FIG. 8 illustrates a control flow diagram in a second embodiment. In FIG. 8, the same operation as that shown in the control flow in FIG. 7 is attached with the same symbol as in FIG. 7 to omit the duplication. Further, configuration of main body is similar to that shown in FIGS. 1-6, and the explanation is omitted.

In step S110 of FIG. 8, the control section acquires print job information from image forming apparatus A through communication section 103B. In the acquired print job information, different from step S11 of FIG. 7, information regarding basis weight and thickness of the paper sheet can be omitted.

In step S12 a print job is started in image forming apparatus A. Incidentally, as the detail will be described later, initial several sheets of the print job have possibility to be trial printing sheets which needs retry (re-print).

In step S13, thickness of the first paper sheet conveyed from image forming apparatus A is detected by paper thickness detection sensor TS which is provided on a conveyance path of sheet introduction section 10 at upstream of second conveyance section 12 in sheet conveyance direction.

In step S21, the control section determines whether the superposing number of sheets n, included in the print job information acquired in step S110, is 1 or 2.

In a case where the control section determines as n=2 in step S21, in the following step S220 the control section calculates the maximum punch processable sheet number m based on detected thickness value of the paper sheet detected in step S13, and determines whether punch processing is possible or not by comparing maximum punch processable sheet number m with number of sheets n to be superposed (=number of sheets to be punched at one time). If the maximum punch processable sheet number m≧number of sheets n, the punch processing is possible.

TABLE 3

| thickness of paper sheet | punch processing max sheet number m |
|---|---|
| 90 μm | 2 sheets |
| 200 μm | 1 sheet |
| 300 μm | not possible |

Table 3 is a reference table of thickness of paper sheet and maximum sheet number of punch processing. Said table is stored in ROM 101B in advance.

In cases where m≧n, the superposing number of sheets is 2, and punch processing is determined to be possible by punch processing section 30 with the state of superposing 2 sheets (step S220: YES), the processing succeeding to step S23 is executed and further the following print job is continued (step S31) to be finished.

On the other hand, in cases where the control section of the post-processing apparatus B determined that the punch processing is not possible (step S220: NO), after executing the processing of step S25, in step S32 the control section notifies image forming apparatus A of stopping the print job under operation and requiring a retry. Meanwhile, since several paper sheets S from the beginning have been already conveyed from sheet feeding tray 3 of image forming apparatus A, said several paper sheets S are ejected to first sheet ejection tray 40 which being different from second sheet ejection tray 81, through superposing section 11 or bypass conveyance path 12. Said several paper sheets S become trial printing sheets, and in cases where the print job is retried, with respect to the number of sheets corresponding to the several number of sheets ejected to first sheet ejection tray 40, image formations based on the same image data are to be executed again.

In step S260 succeeding to step S21, further determined is whether or not punch processing with one sheet is possible. For example if the thickness of the paper sheet is 300 μm, the punch processing is determined to be impossible even for 1 sheet based on the reference table 3 (step S260: NO), the control section notifies to image forming apparatus A to the effect that the punch processing is impossible in the succeeding step S27. At image forming apparatus A, print job setting is changed as necessary, based on the notification.

In step S33, similarly to step S32 the control section notifies image forming apparatus A of stopping the print job under operation and requiring a retry of the print job. In cases of executing the processing of step S33 through steps S25 and S32, the processing of step S33 can be omitted since the similar processing has been already executed.

According to the present embodiment, the paper thickness detection sensor detects the thickness of sheet paper and based on the detected thickness, whether the punch processing is possible or not with superposing state of the paper sheets is determined and the result is notified to the image forming apparatus, therefore, problems such as breakage of the punch processing section are prevented and productivity as total system can be improved.

Third Embodiment

Next, the third embodiment will be described. In the first embodiment (or the second embodiment), the first reference table (or the third reference table) determines the value taking into account of the total area of cut surface in the case of number of punch holes k=4. In contrast, in the third embodiment, a plurality of reference tables corresponding to the number of punch holes k is preliminary prepared.

Figure 9:
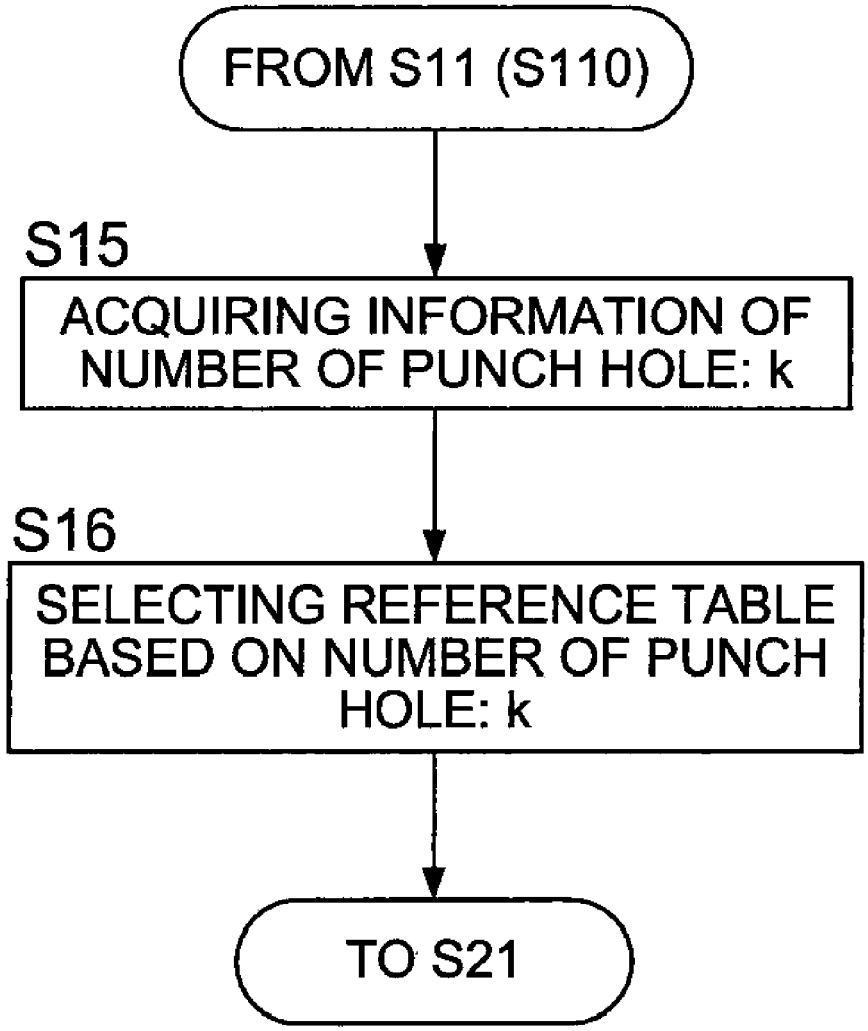
FIG. 9 illustrates a control flow diagram in a third embodiment.

FIG. 9 illustrates a control flow diagram in the third embodiment. Control flow of FIG. 9 is for the process to be executed between step S11 (or step S110) in FIG. 7 (or FIG. 8) and step S21. Since the other processing or configuration than that shown in FIG. 9 are similar to those shown in FIG. 1-7, or 8, the explanation is omitted.

In step S15, the control section acquires the information of number of punch holes k from the information of type of post-processing included in the print job information acquired in step S11.

In step S16, the control section selects a reference table based on the number of punch holes k acquired in step S15.

TABLE 4

| number of punch holes k: 2 holes | |
|---|---|
| basis weight of paper sheet | punch processable max number of sheets |
| 67 g/m$^2$ | 6 sheets |
| 90 g/m$^2$ | 4 sheets |
| 200 g/m$^2$ | 2 sheets |
| 300 g/m$^2$ | 1 sheet |

TABLE 5

| number of punch holes k: 3 holes | |
|---|---|
| basis weight of paper sheet | punch processable max number of sheets m |
| 67 g/m$^2$ | 4 sheets |
| 90 g/m$^2$ | 3 sheets |
| 200 g/m$^2$ | 1 sheet |
| 300 g/m$^2$ | impossible |

TABLE 6

| number of punch holes k: 4 holes | |
|---|---|
| basis weight of paper sheet | punch processable max number of sheets m |
| 67 g/m$^2$ | 3 sheets |
| 90 g/m$^2$ | 2 sheets |
| 200 g/m$^2$ | 1 sheet |
| 300 g/m$^2$ | impossible |

Table 4 is a reference table of basis weight of paper sheet and punch processable maximum number of sheets m with a condition of number of punch holes K=2. Table 5 and table 6 are reference tables respectively corresponding to K=3, and K=4. In the present embodiment, since the punch processing is executed by single drive motor M30, the punch processable number of sheets m at one time is inversely proportional to the number of punch holes K. In cases of making same size punch holes, the punch processable maximum number of sheets m for the case of number of holes k=3 becomes ⅔ times compared to the case of k=2, and m for k=4 becomes ½ times compared to the case of k=2.

After the process of step S16, by using the reference table corresponding to the number of punch holes k determined in step S16, the process of step S21 (or step S220) is executed.

According to the present embodiment, whether the punch processing is possible or not with superposing state of the paper sheets is determined by taking into account of the number of punch holes, and the result is notified to the image forming apparatus, therefore, problems such as breakage of the punch processing section are surely prevented and productivity as total system can be optimally improved.

What is claimed is:

1. A post-processing apparatus which is connectable to an image forming apparatus that forms an image on a paper sheet, the post-processing apparatus comprising:

a first conveyance section which superposes a plurality of paper sheets conveyed from the image forming apparatus, and which is provided with a conveyance path for conveying the plurality of superposed paper sheets toward a downstream side;

a second conveyance section which conveys the plurality of paper sheets conveyed from the image forming apparatus, sheet by sheet toward the downstream side;

a switching section which switches to convey the plurality of paper sheets either to the first conveyance section or to the second conveyance section;

a punch processing section which: (i) is provided at the downstream side of the first and second conveyance sections, (ii) temporarily stops the plurality of paper sheets conveyed from the first or the second conveyance section on a conveyance path, and (iii) executes punch processing to form punch holes in the plurality of paper sheets; and a control section which controls the switching section and the punch processing section, wherein when it is determined, based on basis weight information or thickness information of the paper sheet, that the punch processing is not executable at the punch processing section on the plurality of superposed paper sheets, the control section controls the switching section and the punch processing section to convey the plurality of paper sheets into the second conveyance section, and to execute the punch processing sheet by sheet on the plurality of paper sheets.

2. The post-processing apparatus of claim 1, wherein when it is determined, based on the basis weight information or the thickness information of the paper sheet, that the punch processing is not executable at the punch processing section on the plurality of superposed paper sheets, the control section controls the switching section and the punch processing section to convey the plurality of paper sheets into the second conveyance section, and to execute the punch processing sheet by sheet on the plurality of paper sheets, and in addition, the control section controls the image forming apparatus to make a number of paper sheets to be conveyed from the image forming apparatus per unit time period less than the number of paper sheets in a case of conveying the paper sheets into the first conveyance section.

3. The post-processing apparatus of claim 1, further comprising a paper sheet information acquiring section which acquires the basis weight information or the thickness information of the paper sheet.

4. The post-processing apparatus of claim 3, wherein the paper sheet information acquiring section acquires the basis weight information or the thickness information of the paper sheet from the image forming apparatus.

5. The post-processing apparatus of claim 3, wherein the paper sheet information acquiring section comprises a paper thickness detection sensor which detects the thickness information of the paper sheet, the sensor being provided at an upstream side of the punch processing section in a paper sheet conveyance direction.

6. The post-processing apparatus of claim 3, wherein the control section determines, based on the basis weight information or the thickness information acquired by the paper sheet information acquiring section, whether or not the punch processing is executable at the punch processing section on the plurality of superposed paper sheets.

7. The post-processing apparatus of claim 1, wherein the control section controls a number of punch holes to be formed simultaneously in the paper sheet by the punch processing section.

8. The post-processing apparatus of claim 7, wherein the control section determines, based on the number of the punch holes and the basis weight information or the thickness information acquired by the paper sheet information acquiring section, whether or not the punch processing is executable at the punch processing section on the plurality of superposed paper sheets.

9. An image forming system comprising:

an image forming apparatus comprising an image forming section which forms an image on a paper sheet, and a first control section; and a post-processing apparatus connected to the image forming apparatus, wherein the post-processing apparatus comprises:

a first conveyance section which superposes a plurality of paper sheets conveyed from the image forming apparatus, and which is provided with a conveyance path for conveying the plurality of superposed paper sheets toward a downstream side;

a second conveyance section which conveys the plurality of paper sheets conveyed from the image forming apparatus, sheet by sheet toward the downstream side;

a switching section which switches to convey the plurality of paper sheets either to the first conveyance section or to the second conveyance section;

a punch processing section which temporarily stops the plurality of paper sheets conveyed from the first or the second conveyance section on a conveyance path, and executes punch processing to form punch holes in the plurality of paper sheets; and a second control section which controls the switching section and the punch processing section, wherein when it is determined, based on basis weight information or thickness information of the paper sheet, that the punch processing is not executable at the punch processing section on the plurality of superposed paper sheets, the second control section controls the switching section and the punch processing section to convey the plurality of paper sheets into the second conveyance section, and to execute the punch processing sheet by sheet on the plurality of paper sheets.

10. The image forming system of claim 9, wherein one of the first control section and the second control section determines, based on the basis weight information or the thickness information of the paper sheet, whether or not the punch processing is executable at the punch processing section on the plurality of superposed paper sheets.

11. The image forming system of claim 10, wherein when it is determined, based on the basis weight information or the thickness information of the paper sheet, that the punch processing is not executable at the punch processing section on the plurality of superposed paper sheets, the second control section controls the switching section and the punch processing section to convey the plurality of paper sheets into the second conveyance section, and to execute the punch processing sheet by sheet on the plurality of paper sheets, and in addition, the second control section controls the image forming apparatus to make a number of paper sheets to be conveyed from the image forming apparatus per unit time period less than the number of paper sheets in a case of conveying the paper sheets into the first conveyance section.

12. The image forming system of claim 10, wherein the post-processing apparatus further comprises a paper sheet information acquiring section which acquires the basis weight information or the thickness information of the paper sheet.

13. The image forming system of claim 12, wherein the paper sheet information acquiring section acquires the basis weight information or the thickness information of the paper sheet from the image forming apparatus.

14. The image forming system of claim 12, wherein the paper sheet information acquiring section comprises a paper thickness detection sensor which detects the thickness information of the paper sheet, the sensor being provided at an upstream side of the punch processing section in a paper sheet conveyance direction.

15. The image forming system of claim 12, wherein the second control section determines, based on the basis weight information or the thickness information acquired by the paper sheet information acquiring section, whether or not the punch processing is executable at the punch processing section on the plurality of superposed paper sheets.

16. The image forming system of claim 9, wherein the second control section controls a number of punch holes to be formed simultaneously in the paper sheet by the punch processing section.

17. The image forming system of claim 9, wherein one of the first control section and the second control section determines, based on the number of the punch holes and the basis weight information or the thickness information acquired by the paper sheet information acquiring section, whether or not the punch processing is executable at the punch processing section on the plurality of superposed paper sheets.

* * * * *